US007061185B2

(12) United States Patent
Yoon

(10) Patent No.: US 7,061,185 B2
(45) Date of Patent: Jun. 13, 2006

(54) METHOD OF DRIVING PLASMA DISPLAY PANEL

(75) Inventor: Sang Jin Yoon, Kyoungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 153 days.

(21) Appl. No.: 10/743,800

(22) Filed: Dec. 24, 2003

(65) Prior Publication Data

US 2004/0135747 A1 Jul. 15, 2004

(30) Foreign Application Priority Data

Dec. 26, 2002 (KR) ..... 10-2002-0084607

(51) Int. Cl.
*G09G 3/10* (2006.01)

(52) U.S. Cl. ..... 315/169.1; 315/169.3; 345/60; 345/208

(58) Field of Classification Search ..... 315/169.1, 315/169.3, 169.4; 345/60, 208
See application file for complete search history.

(56) References Cited

U.S. PATENT DOCUMENTS

2002/0033675 A1* 3/2002 Kang et al. ..... 315/169.1

* cited by examiner

*Primary Examiner*—David Vu
(74) *Attorney, Agent, or Firm*—Fleshner & Kim, LLP

(57) ABSTRACT

A plasma display panel driving method for reducing power consumption in a case of simultaneously performing a selective writing and a selective erasing within one frame interval is disclosed. In the method, one frame includes a plurality of selective writing sub-fields and a plurality of selective erasing sub-fields. An erasing data pulse is applied only in an address period of any one of the plurality of selective erasing sub-fields so as to turn off a discharge cell.

21 Claims, 5 Drawing Sheets

METHOD OF DRIVING PLASMA DISPLAY PANEL

BACKGROUND OF THE INVENTION

1. Field of the Invention

This invention relates to a technique for driving a plasma display panel, and more particularly to a plasma display panel driving method that is adaptive for reducing power consumption in a case of simultaneously performing a selective writing and a selective erasing within one frame interval.

2. Description of the Related Art

Generally, a plasma display panel (PDP) radiates a phosphorus material using an ultraviolet ray with a wavelength of 14 nm generated upon discharge of a gas such as He+Xe, Ne+Xe or He+Ne+Xe, to thereby display a picture including characters or graphics. Such a PDP is easy to be made into a thin-film and large-dimension type. Moreover, the PDP provides a very improved picture quality owing to a recent technical development. Particularly, a three-electrode, alternating current (AC) surface-discharge type PDP has advantages of a low-voltage driving and a long life in that it can lower a voltage required for a discharge using wall charges accumulated on the surface thereof during the discharge and protect the electrodes from a sputtering caused by the discharge.

Referring to FIG. 1, a discharge cell of the three-electrode, AC surface-discharge PDP includes a scan electrode 30Y and a sustain electrode 30Z formed on an upper substrate 10, and an address electrode 20X formed on a lower substrate 18.

The scan electrode 30Y and the sustain electrode 30Z includes transparent electrodes 12Y and 12Z, and metal bus electrodes 13Y and 13Z having a smaller line width than the transparent electrodes 12Y and 12Z and provided at one edge of the transparent electrode, respectively. The transparent electrodes 12Y and 12Z are formed from indium-tin-oxide (ITO) on the upper substrate 10. The metal bus electrodes 13Y and 13Z are formed on the transparent electrodes 12Y and 12Z from a metal such as chrome (Cr) to thereby reduce a voltage drop caused by the transparent electrodes 12Y and 12Z having a high resistance.

On the upper substrate 10 provided with the scan electrode 30Y and the sustain electrode 30Z, an upper dielectric layer 14 and a protective film 16 are disposed. Wall charges generated upon plasma discharge are accumulated onto the upper dielectric layer 14. The protective film 16 protects the upper dielectric layer 14 from a sputtering of the charged particles generated during the plasma discharge and improves the emission efficiency of secondary electrons. This protective film 16 is usually made from MgO.

The address electrode 20X is formed in a direction crossing the scan electrode 30Y and the sustain electrode 30Z. A lower dielectric layer 22 and barrier ribs 24 are formed on the lower substrate 18 provided with the address electrode 20X. A phosphorous material layer 26 is formed on the surfaces of the lower dielectric layer 22 and the barrier ribs 24. The barrier ribs 24 are formed in parallel to the address electrode 20X to divide the discharge cells physically, and prevents an ultraviolet ray and a visible light generated by the discharge from being leaked into adjacent discharge cells.

The phosphorous material layer 26 is excited and radiated by an ultraviolet ray generated upon discharge to produce any one of red, green and blue color visible lights. An inactive mixture gas, such as He+Xe, Ne+Xe or He+Ne+Xe, for a gas discharge is injected into a discharge space defined between the upper/lower substrate 10 and 18 and the barrier ribs 24.

Such a three-electrode AC surface-discharge PDP drives one frame, which is divided into various sub-fields having a different emission frequency, so as to realize gray levels of a picture. Each sub-field is again divided into a reset period for uniformly causing a discharge, an address period for selecting the discharge cell and a sustain period for realizing the gray levels depending on the discharge frequency.

If it is intended to display a picture of 256 gray levels, then a frame interval equal to 1/60 second (i.e. 16.67 msec) is divided into 8 sub-fields SF1 to SF8 as shown in FIG. 2. Each of the 8 sub-field SF1 to SF8 is divided into a reset period, an address period and a sustain period. The reset period and the address period of each sub-field are equal every sub-field, whereas the sustain period and the discharge frequency are increased at a ratio of $2^n$ (wherein n=0, 1, 2, 3, 4, 5, 6 and 7) at each sub-field. As the sustain period at each sub-field is differentiated as mentioned above, a gray level of a picture can be implemented.

Such a PDP driving method is largely classified into a selective writing system and a selective erasing system depending on whether or not there is an light-emission of the discharge cell selected by the address discharge.

The selective writing system turns on the discharge cells selected in the address period after turning off the entire field in the reset period. In the sustain period, a discharge of the discharge cells selected by the address discharge is sustained to thereby display a picture.

In the selective writing system, a scanning pulse applied to the scan electrode 30Y must be set to have a relatively large pulse width, thereby forming sufficient wall charges within the discharge cell.

If the PDP has a resolution of VGA (video graphics array) class, it has total 480 scanning lines. Accordingly, in the selective writing system, an address period within one frame requires total 11.52 ms when one frame interval (i.e., 16.67 ms) includes 8 sub-fields. On the other hand, a sustain period is assigned to 3.05 ms in consideration of a vertical synchronizing signal Vsync. Herein, assuming that a pulse width of the scanning pulse should be 3 μs, the address period is calculated by 3 μs (a pulse width of the scanning pulse)×480 lines×8 (the number of sub-fields) per frame. The sustain period is a time value (i.e., 16.67 ms−11.52 ms−0.3 ms−1 ms−0.8 ms) obtained by subtracting an address period of 11.52 ms, once reset period of 0.3 ms, an erasure interval of 100 μs×8 sub-fields and an extra time of the vertical synchronizing signal Vsync of 1 ms from one frame interval of 16.67 ms.

The PDP may generate a pseudo contour noise from a moving picture because of its characteristic realizing the gray levels of the picture by a combination of sub-fields. If the pseudo contour noise is generated, then a pseudo contour emerges on the screen to thereby deteriorate a picture display quality. For instance, if the screen is moved to the left after the left half of the screen was displayed by a gray level value of 128 and the right half of the screen was displayed by a gray level value of 127, then a peak white, that is, a white stripe emerges at a boundary portion between the gray level values 128 and 127. To the contrary, if the screen is moved to the right after the left half thereof was displayed by a gray level value of 128 and the right half thereof was displayed by a gray level value of 127, then a black level, that is, a black stripe emerges on at a boundary portion between the gray level values 127 and 128.

In order to eliminate a pseudo contour noise of a moving picture, there has been suggested a scheme of dividing one sub-field to add one or two sub-fields, a scheme of re-arranging the sequence of sub-fields, a scheme of adding the sub-fields and re-arranging the sequence of sub-fields, and an error diffusion method, etc. However, in the selective writing system, if the sub-fields are added so as to eliminate a pseudo contour noise of a moving picture, then the sustain period becomes insufficient or fails to be assigned. For instance, in the selective writing system, if two sub-fields of the 8 sub-fields are divided such that one frame includes 10 sub-fields, then the display period, that is, the sustain period becomes absolutely insufficient as follows. If one frame includes 10 sub-fields, then the address period becomes 14.4 ms, which is calculated by 3 μs (a pulse width of the scanning pulse)×480 lines×10 (the number of sub-fields) per frame. On the other hand, the sustain period becomes −0.03 ms (i.e., 16.67 ms−14.4 ms−0.3 ms−1 ms−1 ms), which is a time value obtained by subtracting an address period of 14.4 ms, once reset period of 0.3 ms, an erasure period of 100 μs×10 sub-fields and an extra time of the vertical synchronizing signal Vsync of 1 ms from one frame interval of 16.67 ms.

In such a selective writing system, a sustain period of about 3 ms can be assured when one frame consists of 8 sub-fields, whereas it becomes impossible to assure a time for the sustain period when one frame consists of 10 sub-fields. In order to overcome this problem, there has been suggested a scheme of making a divisional driving of one field. However, such a scheme raises another problem of a rise of manufacturing cost because it requires an addition of driver IC's.

A contrast characteristic of the selective writing system is as follows. In the selective writing system, when one frame consists of 8 sub-fields, a light of about 300 cd/m$^2$ corresponding to a brightness of the peak white is produced if a field continues to be turned on in the entire sustain period of 3.05 ms. On the other hand, if the field is sustained in a state of being turned on only in once reset period and being turned off in the remaining interval within one frame, then a light of about 0.7 cd/m$^2$ corresponding to the black is produced. Accordingly, a darkroom contrast ratio in the selective writing system has a level of 430:1.

The selective erasing system makes a writing discharge of the entire field in the reset period and thereafter turns off the discharge cells selected in the address period. Then, in the sustain period, only the discharge cells having not selected by the address discharge are subject to a sustain discharge to thereby display a picture.

In the selective erasing system, a selective erasing data pulse having a pulse width of about 1 μs is applied to the address electrode 20X so that it can erase wall charges and space charges of the discharge cells selected during the address discharge. At the same time, a scanning pulse, having a pulse with of 1 μs, synchronized with the selective erasing data pulse is applied to the scan electrode 30Y.

In the selective writing system, if the PDP has a resolution of VGA (video graphics array) class, then an address period within one frame requires only total 3.84 ms when one frame interval (i.e., 16.67 ms) consists of 8 sub-fields. On the other hand, a sustain period can be sufficiently assigned to about 10.73 ms in consideration of a vertical synchronizing signal Vsync. Herein, the address period is calculated by 1 μs (a pulse width of the scanning pulse)×480 lines×8 (the number of sub-fields) per frame. The sustain period is a time value (i.e., 16.67 ms−3.84 ms−0.3 ms−1 ms−0.8 ms) obtained by subtracting an address period of 3.84 ms, once reset period of 0.3 ms, and an extra time of the vertical synchronizing signal Vsync of 1 ms and an entire writing time of 100 μs×8 sub-fields from one frame interval of 16.67 ms.

In such a selective erasing system, since the address period is small, the sustain period as a display period can be assured even though the number of sub-fields is increased. If the number of sub-fields SF1 to SF10 within one frame is increased into ten as shown in FIG. 3, then the address period becomes 4.8 ms, which is calculated by 1 μs (a pulse width of the scanning pulse)×480 lines×10 (the number of sub-fields) per frame. On the other hand, the sustain period becomes 9.57 ms, which is a time value (i.e., 16.67 ms−4.8 ms−0.3 ms−1 ms−1 ms) obtained by subtracting an address period of 4.8 ms, once reset period of 0.3 ms, an extra time of the vertical synchronizing signal Vsync of 1 ms and the entire writing time of 100 μs×10 sub-fields from one frame interval of 16.67 ms. Accordingly, the selective erasing system can assure a sustain period three times longer than the above-mentioned selective writing system having 8 sub-fields even though the number of sub-fields is enlarged into ten, so that it can realize a bright picture with 256 gray levels.

However, the selective erasing system has a disadvantage of low contrast because the entire field is turned on in the entire writing interval that is a non-display interval.

In the selective erasing system, if the entire field continues to be turned on in the sustain period of 9.57 ms within one frame consisting of 10 sub-fields SF1 to SF10 as shown in FIG. 3, then a light of about 950 cd/m$^2$ corresponding to a brightness of the peak white is produced. A brightness corresponding to the black is 15.7 cd/m$^2$, which is a brightness value of 0.7 cd/m$^2$ generated in once reset period plus 1.5 cd/m$^2$×10 sub-fields generated in the entire writing interval within one frame. Accordingly, since a darkroom contrast ratio in the selective erasing system is equal to a level of 950:15.7=60:1 when one frame consists of 10 sub-fields SF1 to SF10, the selective erasing system has a low contrast. As a result, a driving method using the selective erasing system provides a bright field owing to an assurance of sufficient sustain period, but fails to provide a clear field and a feeling of blurred picture due to a poor contrast.

In order to overcome a problem caused by such a poor contrast, there has been suggested a scheme of making an entire writing only once per frame and taking out the unnecessary discharge cells every sub-field SF1 to SF10. However, this scheme has a problem of poor picture quality in that, since the discharge cell can be selected at the next sub-field only when the previous sub-field has been necessarily turned on, the number of gray levels becomes merely the number of sub-fields plus one. In other words, if one frame includes 10 sub-fields, then the number of gray level becomes merely eleven as indicated by the following table:

TABLE 1

| Gray Level | SF1 (1) | SF2 (2) | SF3 (4) | SF4 (8) | SF5 (16) | SF6 (32) | SF7 (48) | SF8 (48) | SF9 (48) | SF10 (48) |
|---|---|---|---|---|---|---|---|---|---|---|
| 0 | x | x | x | x | x | x | x | x | x | x |
| 1 | o | x | x | x | x | x | x | x | x | x |
| 3 | o | o | x | x | x | x | x | x | x | x |
| 7 | o | o | o | x | x | x | x | x | x | x |
| 15 | o | o | o | o | x | x | x | x | x | x |
| 31 | o | o | o | o | o | x | x | x | x | x |
| 63 | o | o | o | o | o | o | x | x | x | x |
| 111 | o | o | o | o | o | o | o | x | x | x |
| 159 | o | o | o | o | o | o | o | o | x | x |
| 207 | o | o | o | o | o | o | o | o | o | x |
| 255 | o | o | o | o | o | o | o | o | o | o |

In Table 1, 'SFx' means the xth sub-field; and '(y)' expresses a weighting value set at the corresponding sub-field by a decimal number y. Further, 'O' represents a state in which the corresponding sub-field is turned on; and 'x' represents a state in which the corresponding sub-field is turned off.

In this case, since only 1331 colors are expressed by all combination of red, green and blue colors, color expression ability becomes considerably low in comparison to 16,700,000 true colors. The PDP adopting such a system has a darkroom contrast ratio of 430:1 by a peak white of 950 cd/m$^2$ when the entire field is turned on in the display interval of 9.57 ms and a black of 2.2 cd/m$^2$ which is a brightness value obtained by adding a brightness of 0.7 cd/m$^2$ generated in once reset period to a brightness of 1.5 cd/m$^2$ generate in once entire writing interval.

As described above, in the conventional PDP driving method, the selective writing system fails to drive the PDP at a high speed because the data pulse and the scanning pulse for selectively turning on the discharge cells during the address period must have a pulse width of more than 3 μs. The selective erasing system has an advantage in that it can drive the PDP at a high speed because the data pulse and the scanning pulse for selectively turning off the discharge cells may has a pulse width of 1 μs that is narrower than those in the selective writing system, whereas it has a disadvantage of a worse contrast than the selective writing system because the discharge cells at the entire field is turned on in the reset period, that is, the non-display interval.

In order to overcome a problem in each of the conventional selective writing system or the conventional selective erasing system, there has been suggested a selective writing and selective erasing (SWSE) scheme in which a combination of a plurality of selective writing sub-fields with a plurality of selective erasing sub-fields are arranged within one frame interval. However, such a conventional SEWE scheme raises a problem in that an unnecessary data is applied during a period of the selective erasing sub-field to cause a lot of power consumption.

SUMMARY OF THE INVENTION

Accordingly, it is an object of the present invention to provide a plasma display panel driving method that is adaptive for reducing power consumption in a case of simultaneously performing a selective writing and a selective erasing within one frame interval.

In order to achieve these and other objects of the invention, a method of driving a plasma display panel according to an embodiment of the present invention wherein one frame includes a plurality of selective writing sub-fields and a plurality of selective erasing sub-fields, includes the step of applying an erasing data pulse only in an address period of any one of the plurality of selective erasing sub-fields so as to turn off a discharge cell.

In the method, if the discharge cell has been turned off at the nth sub-field (wherein n is an integer), then said erasing data pulse is not generated in the address periods of the selective erasing sub-fields arranged after the nth sub-field.

Herein, the nth sub-field is a selective erasing sub-field.

Alternatively, the nth sub-field is a selective writing sub-field arranged prior to said selective erasing sub-field.

In a method of driving a plasma display panel according to another embodiment of the present invention, one frame includes a plurality of selective writing sub-fields and a plurality of selective erasing sub-fields, and the number of erasing data pulses applied to turn off a specific discharge cell during an interval of the plurality of selective erasing sub-fields is in inverse proportion to the number of selective writing sub-fields turning on the specific discharge cell.

Herein, if said specific discharge cell has been turned on at at least four selective writing sub-fields during said one frame, then a single of erasing data pulse is applied to turn off the specific discharge cell.

Alternatively, if said specific discharge cell has been turned on at a single of selective writing sub-field during said one frame, then three erasing data pulses are applied to turn off the specific discharge cell.

Herein, said erasing data pulse is continuously applied to adjacent selective erasing sub-fields.

Alternatively, if said specific discharge cell has been turned on at at least two selective writing sub-fields during said one frame, then two erasing data pulses are applied to turn off the specific discharge cell.

Herein, said erasing data pulse is continuously applied to adjacent selective erasing sub-fields.

In a method of driving a plasma display panel according to still another embodiment of the present invention, one frame includes a plurality of selective writing sub-fields and a plurality of selective erasing sub-fields, and the number of erasing data pulses applied to turn off a specific discharge cell during an interval of the plurality of selective erasing sub-fields is in inverse proportion to the number of selective writing sub-fields and selective erasing sub-fields that turn on the specific discharge cell during said one frame interval.

Herein, if said specific discharge cell has been turned on at at least four sub-fields during said one frame, then a single of erasing data pulse is applied to turn off the specific discharge cell.

Alternatively, if said specific discharge cell has been turned on at a single of sub-field during said one frame, then three erasing data pulses are applied to turn off the specific discharge cell.

Herein, said erasing data pulse is continuously applied to adjacent selective erasing sub-fields.

Alternatively, if said specific discharge cell has been turned on at at least two sub-fields during said one frame, then two erasing data pulses are applied to turn off the specific discharge cell.

Herein, said erasing data pulse is continuously applied to adjacent selective erasing sub-fields.

A method of driving a plasma display panel according to still another embodiment of the present invention wherein one frame includes a plurality of selective writing sub-fields and a plurality of selective erasing sub-fields, includes the steps of applying a writing data pulse during an address period of said selective writing sub-field to thereby select a specific discharge cell into an on-cell; and applying an erasing data pulse during an address period of at least one selective erasing sub-field of the plurality of selective erasing sub-fields to thereby turn off the specific discharge cell, wherein the number of said erasing data pulses applied to the specific discharge cell is set to be differentiated depending upon a peripheral temperature at which the panel is driven.

In the method, when the panel is driven at a high temperature, i erasing data pulses (wherein i is an integer) are applied to the specific discharge cell.

Herein, said high temperature is more than 40° C.

Alternatively, when the panel is driven at a low temperature, j erasing data pulses (j is an integer than larger than i) are applied to the specific discharge cell.

Herein, said low temperature is less than 0° C.

Alternatively, when the panel is driven at a temperature between said high temperature and said low temperature, erasing data pulses having the number larger than i and smaller than j are applied to the specific discharge cell.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
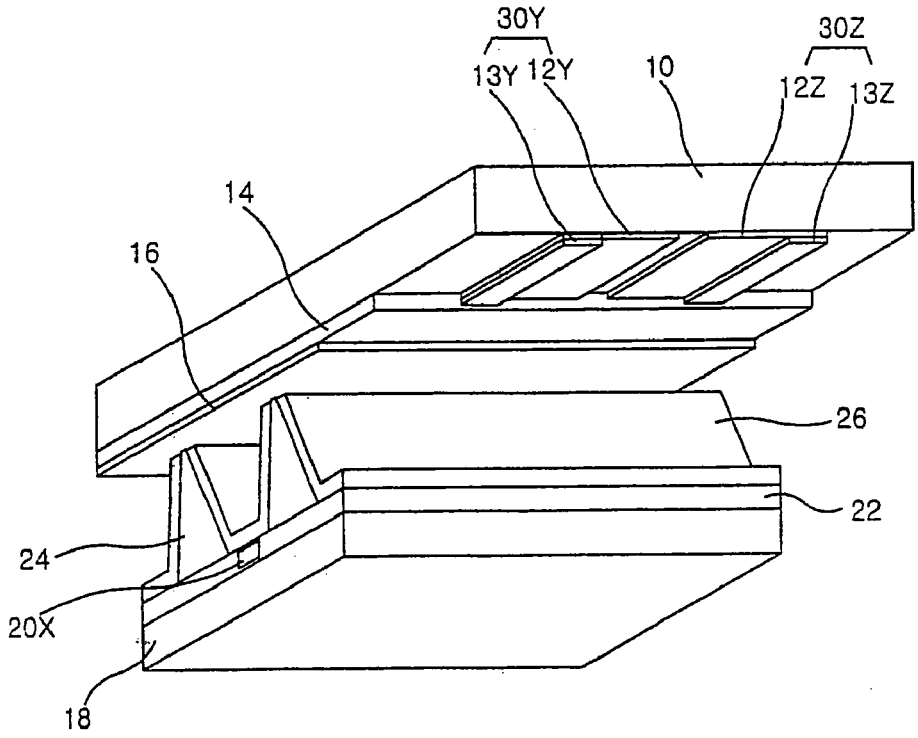
FIG. 1 PRIOR ART
FIG. 1 is a perspective view showing a discharge cell structure of a conventional three-electrode AC surface-discharge plasma display panel.
Figure 2:
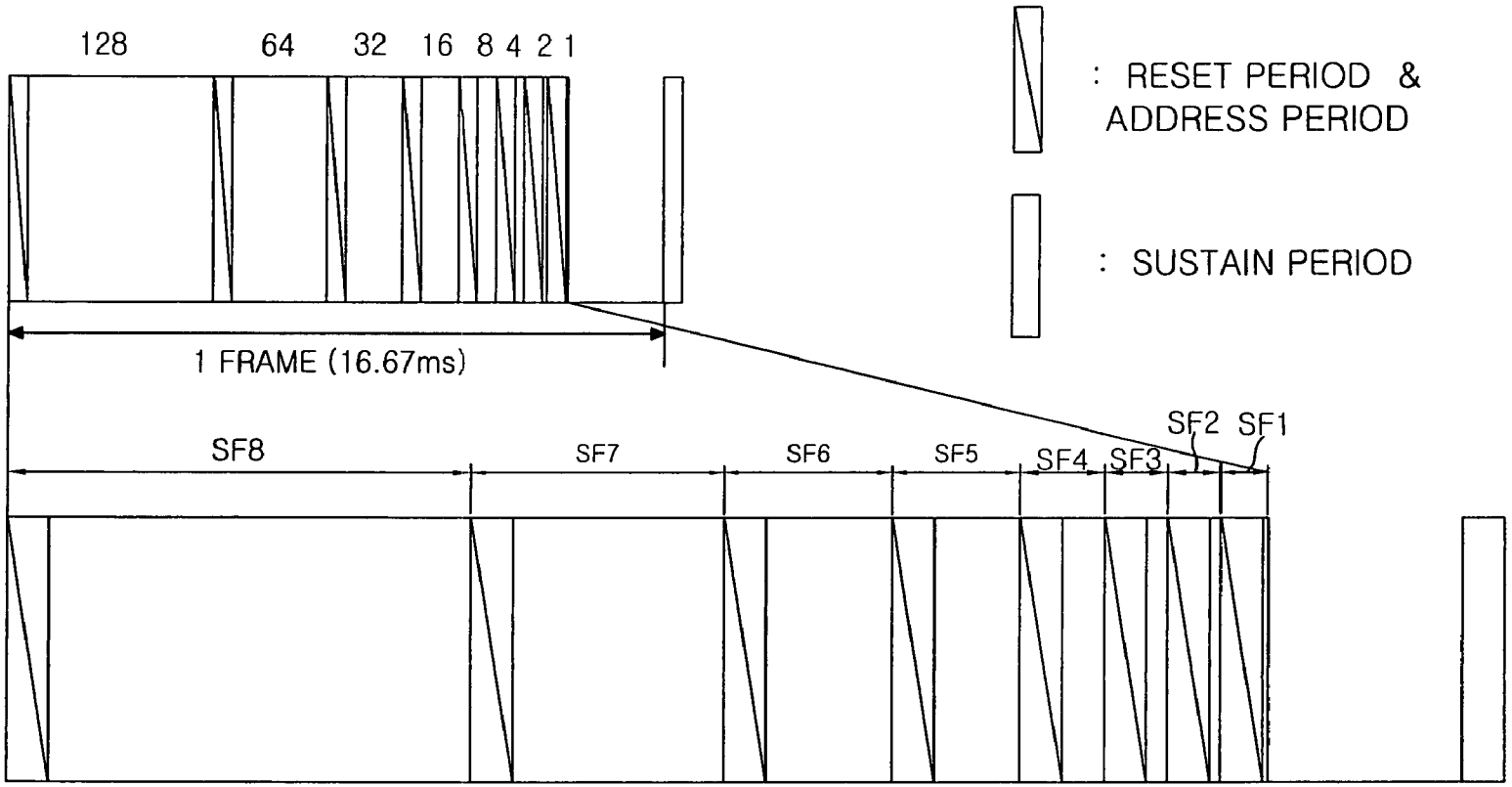
FIG.2 RELATED ART
FIG. 2 illustrates one frame including 8 sub-fields in a method of driving the conventional plasma display panel.
Figure 3:
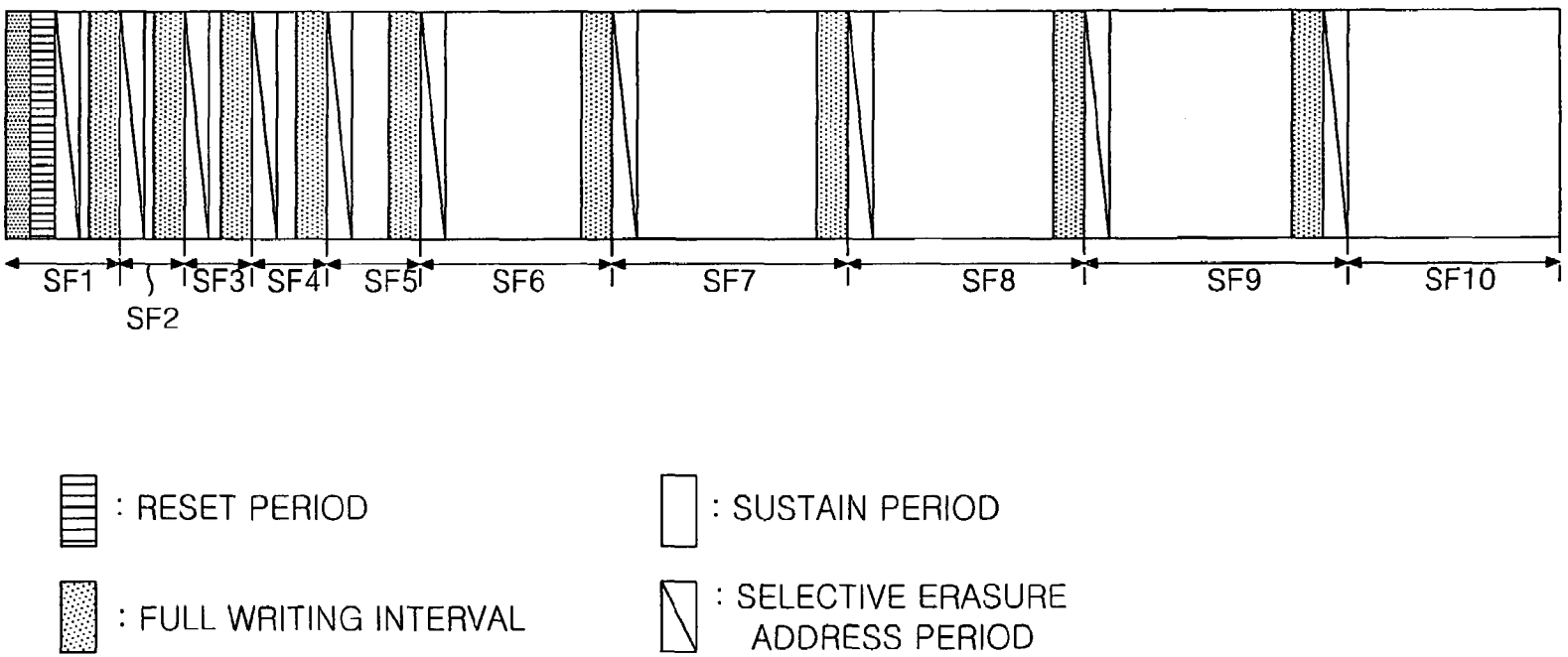
FIG.3 RELATED ART
FIG. 3 illustrates a configuration of one frame including 8 sub-fields and having an entire writing discharge preceded for each sub-field in the method of diving the conventional plasma display panel.
Figure 4:
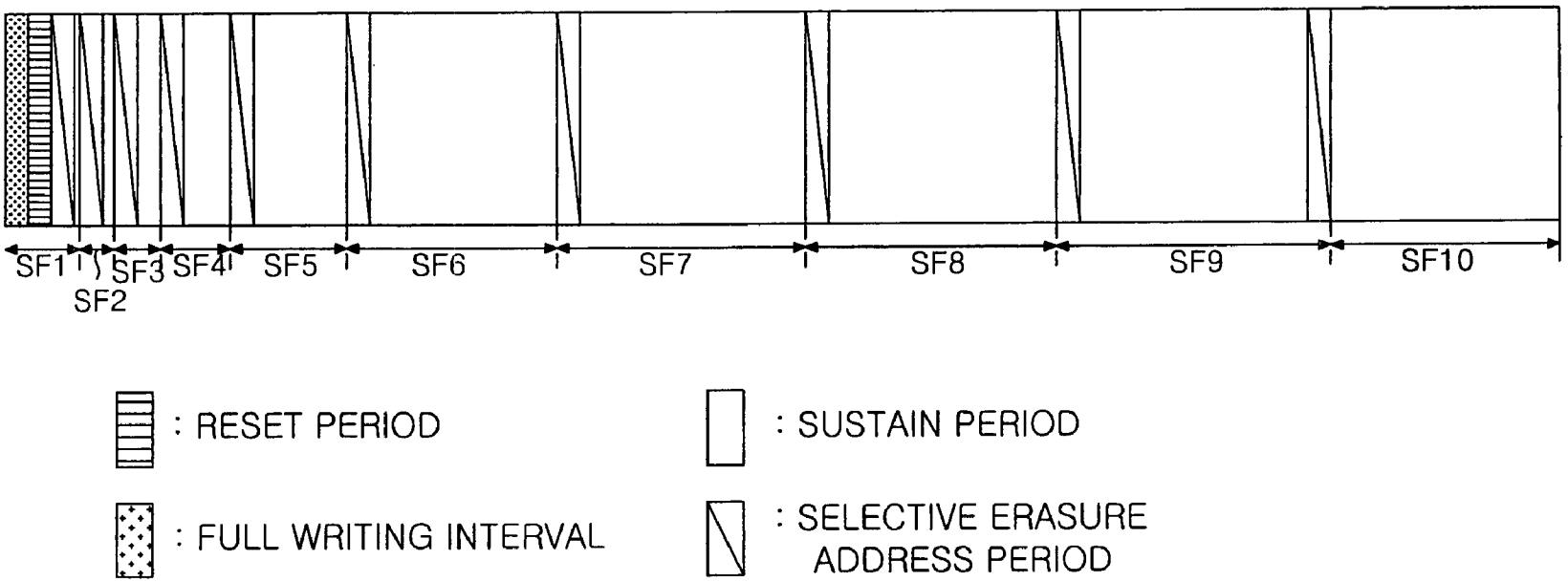
FIG.4 RELATED ART
FIG. 4 illustrates a configuration of one frame including 8 sub-fields and including once entire writing discharge in the method of diving the conventional plasma display panel.
Figure 5:
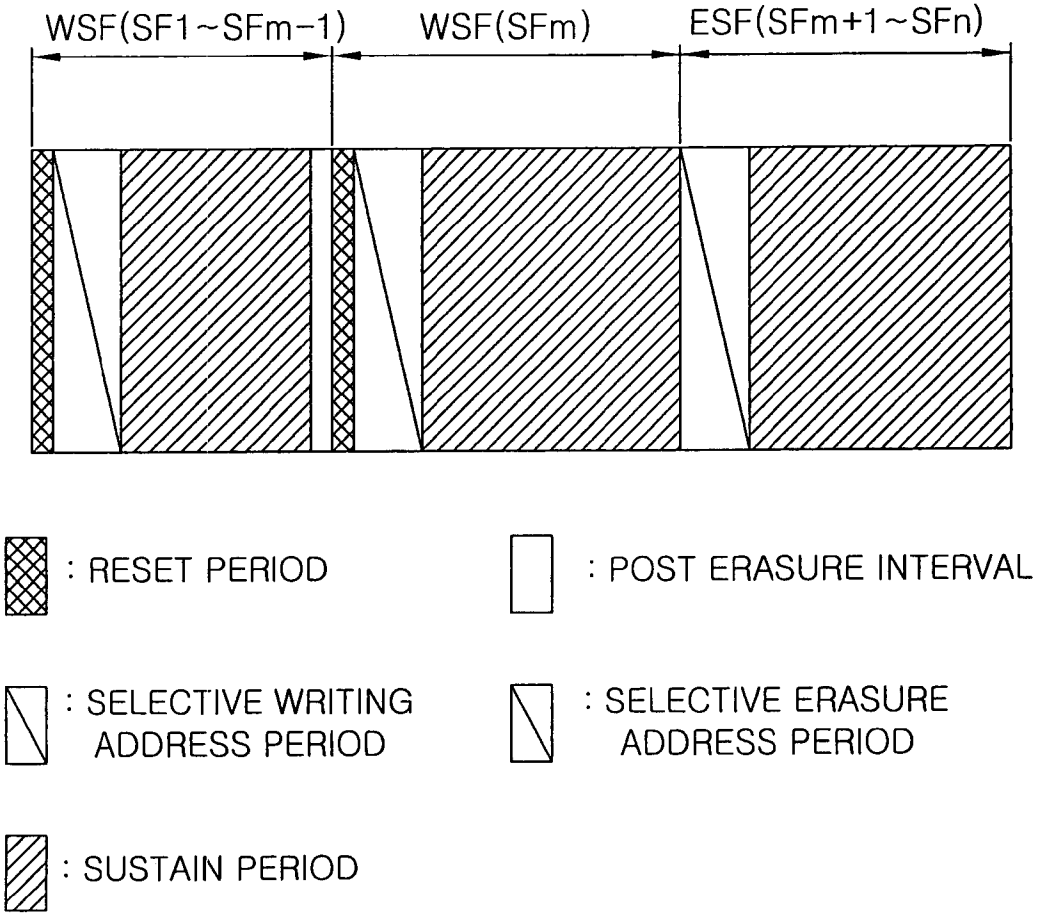
FIG. 5 illustrates a configuration of one frame in a method of driving a PDP according to an embodiment of the present invention.

FIG. 5 shows a configuration of one frame in a method of driving a PDP according to an embodiment of the present invention.

Referring to FIG. 5, one frame is comprised of a selective writing sub-field WSF including at least one sub-field, and a selective erasing sub-field ESF including at least one sub-field.

The selective writing sub-field WSF includes m sub-fields SF1 to SFm (wherein m is an integer). Each of the first to (m−1)th sub-fields SF1 to SFm−1 other than the mth sub-field SFm is divided into a reset period for uniformly forming a certain amount of wall charges at the cells of the entire field, a selective writing address period (hereinafter simply referred to as "writing address period") for selecting on-cells using the writing discharge, a sustain period for causing a sustain discharge with respect to the selected on-cell and a post erasure interval for erasing wall charges within the cell after the sustain discharge. The mth sub-field SFm, which is the last sub-field of the selective writing sub-field WSF, is divided into a reset period, a writing address period and a sustain period. The reset period, the writing address period and the erasure interval of the selective writing sub-field WSF are equal to each other for each sub-field SF1 to SFm, whereas the sustain period may be set equally or differently depending upon a predetermined brightness weighting value.

The selective erasing sub-field ESF includes (n−m) sub-fields SFm+1 to SFn (wherein n is an integer larger than m). Each of the (m+1)th to (n−1)th sub-fields SFm+1 to SFn−1 is divided into an selective erasure address period (hereinafter simply referred to as "erasure address period") for selecting off-cells using an erasure discharge, and a sustain period for causing a sustain discharge with respect to the on-cells.

In the sub-fields SFm+1 to SFn of the selective erasing sub-field ESF, the erasure address period is set equally, whereas the sustain period may be set equally or differently depending upon a brightness relative ratio.

A data coding method for addressing will be described below.

If it is assumed that one frame should be configured by 6 selective writing sub-fields SF1 to SF6 in which a brightness relative ratio is given differently to "$2^0$, $2^1$, $2^2$, $2^3$, $2^4$, $2^5$" and 6 selective erasing sub-fields SF7 to SF12 in which a brightness relative ratio is given equally to "$2^5$", then a gray level and a coding method expressed by a combination of the sub-fields SF1 to SFn is given in the following table:

TABLE 2

| Gray Level | SF1 (1) | SF2 (2) | SF3 (4) | SF4 (8) | SF5 (16) | SF6 (32) | SF7 (32) | SF8 (32) | SF9 (32) | SF10 (32) | SF11 (32) | SF12 (32) |
|---|---|---|---|---|---|---|---|---|---|---|---|---|
| 0~31 | Binary coding | | | | | x | x | x | x | x | x | x |
| 32~63 | Binary coding | | | | | ○ | x | x | x | x | x | x |
| 64~95 | Binary coding | | | | | ○ | ○ | x | x | x | x | x |
| 96~127 | Binary coding | | | | | ○ | ○ | ○ | x | x | x | x |

TABLE 2-continued

| Gray Level | SF1 (1) | SF2 (2) | SF3 (4) | SF4 (8) | SF5 (16) | SF6 (32) | SF7 (32) | SF8 (32) | SF9 (32) | SF10 (32) | SF11 (32) | SF12 (32) |
|---|---|---|---|---|---|---|---|---|---|---|---|---|
| 128~159 | Binary coding | | | | | ○ | ○ | ○ | ○ | x | x | x |
| 160~191 | Binary coding | | | | | ○ | ○ | ○ | ○ | ○ | x | x |
| 192~223 | Binary coding | | | | | ○ | ○ | ○ | ○ | ○ | ○ | x |
| 224~255 | Binary coding | | | | | ○ | ○ | ○ | ○ | ○ | ○ | ○ |

As can be seen from the above Table 2, the first to fifth sub-fields SF1 to SF5 arranged at the front of the frame determine a brightness of the cell by the binary coding to thereby express a gray level value. The sixth to twelfth sub-fields SF6 to SF12 determine a brightness of the cell by the linear coding at more than a desired gray level value to thereby express a gray level value. For instance, the cell corresponding to a gray level value '11' is selected into an on-cell at the first, second and fourth sub-fields SF1, SF2 and SF4 in which the respective brightness relative ratio are $2^0$ (1), $2^1$ (2) and $2^3$ (8) by the binary code combination to thereby be turned on while being selected into an off-cell at the remaining sub-fields to thereby be turned off. On the other hand, the cell corresponding to a gray level value '74' is selected into an on-cell at the second and fourth sub-fields SF2 and SF4 by the binary code combination and is selected into an on-cell at the sixth and seventh sub-fields SF6 and SF7 by the linear code combination to thereby be turned on while being selected into an off-cell at the remaining sub-fields to thereby be turned off.

The seventh to twelfth sub-fields SF7 to SF12 of the selective erasing sub-field ESF select off-cells from on-cells whenever they are transited into the next sub-fields. In other words, the seventh to twelfth sub-fields SF7 to SF12 of the selective erasing sub-field ESF sequentially take out the unnecessary cells from the on-cells having been turned on at the previous sub-field to thereby select off-cells. For this reason, on-cells turned on at more than a desired gray level value should be necessarily turned on at the sixth sub-field SF6, which is the last sub-field of the selective writing sub-field WSF, or the previous selective erasing sub-field ESF.

For instance, off-cells turned off at the seventh sub-field SF7 are selected from on-cells selected at the sixth sub-field SF6 while off-cells turned off at the eighth sub-field SF8 are selected from the remaining on-cells at the seventh sub-field SF6. Accordingly, the seventh sub-fields SF7 of the selective erasing sub-field ESF does not require a separate writing discharge for turning on the cells of the entire field prior to the erasure address period.

If it is assumed that the PDP should have a resolution of VGA class, that is, 480 scan lines when the selective writing sub-fields WSF and the selective erasing sub-fields ESF at one frame are arranged as indicated in the above Table 2, then total address period requires 11.52 ms. On the other hand, the sustain period requires 3.35 ms. Herein, when a pulse width of the scanning pulse assigned to the selective writing sub-field is 3 μs and a pulse width of the scanning pulse assigned to the selective erasing sub-field is 1 μs, the address period is a sum of 8.64 ms calculated by 3 μs (a pulse width of the selective writing scanning pulse)×480 lines×6 (the number of selective writing sub-fields) with 2.88 ms calculated by 1 μs (a pulse width of the selective erasure scanning pulse)×480 lines×6 (the number of selective erasing sub-fields) per frame. On the other hand, the sustain period is a time value (i.e., 16.67 ms−8.64 ms−2.88 ms−0.3 ms−1 ms−0.5 ms) obtained by subtracting an address period of 11.52 ms, once reset period of 0.3 ms, an erasure interval of 100 μs×5 (the number of sub-fields)=0.5 ms and an extra time of the vertical synchronizing signal Vsync of 1 ms from one frame interval of 16.67 ms.

Accordingly, the PDP driving method according to the embodiment of the present invention increases the number of sub-fields in comparison with the conventional selective writing system, thereby reducing a pseudo contour noise from a moving picture. Furthermore, the PDP driving method according to the embodiment of the present invention can assure a greater time of sustain period that is increased from 3.05 ms when one frame includes 8 sub-fields in the conventional selective writing system into 3.35 ms.

When the selective writing sub-field WSF and the selective erasing sub-field ESF at one frame are arranged as indicated in the above Table 2, if the entire field continues to be turned on in the sustain period of 3.35 ms, then a light of about 330 cd/$m^2$ corresponding to a brightness of the peak white is produced. If the field is turned on only in once reset period within one frame, then a light of about 0.7 cd/$m^2$ corresponding to a black is produced. Accordingly, a dark-room contrast ratio in the PDP driving method according to the embodiment of the present invention is a level of 470:1, so that it permits an improved contrast in light of a contrast ratio (i.e., 60:1) in the conventional selective erasing system in which one frame includes 10 sub-fields. Further, the PDP driving method according to the embodiment of the present invention has an enhanced contrast characteristic in light of a contrast ratio (i.e., 430:1) in the conventional selective writing system in which one frame interval includes 8 sub-fields.

Meanwhile, a data pulse applied really when a specific gray level is expressed is defined by the following table:

TABLE 3

| Gray Level | SF1 (1) | SF2 (2) | SF3 (4) | SF4 (8) | SF5 (16) | SF6 (32) | SF7 (32) | SF8 (32) | SF9 (32) | SF10 (32) | SF11 (32) | SF12 (32) |
|---|---|---|---|---|---|---|---|---|---|---|---|---|
| 0 | Binary coding | | | | | "0" | '1' | '1' | '1' | '1' | '1' | '1' |
| 224 | Binary coding | | | | | "1" | '0' | '0' | '0' | '0' | '0' | '0' |
| 192 | Binary coding | | | | | "1" | '0' | '0' | '0' | '0' | '0' | '1' |
| 160 | Binary coding | | | | | "1" | '0' | '0' | '0' | '0' | '1' | '1' |

TABLE 3-continued

| Gray Level | SF1 (1) | SF2 (2) | SF3 (4) | SF4 (8) | SF5 (16) | SF6 (32) | SF7 (32) | SF8 (32) | SF9 (32) | SF10 (32) | SF11 (32) | SF12 (32) |
|---|---|---|---|---|---|---|---|---|---|---|---|---|
| 128 | | Binary coding | | | | "1" | '0' | '0' | '0' | '1' | '1' | '1' |
| 96 | | Binary coding | | | | "1" | '0' | '0' | '1' | '1' | '1' | '1' |
| 64 | | Binary coding | | | | "1" | '0' | '1' | '1' | '1' | '1' | '1' |
| 32 | | Binary coding | | | | "1" | '1' | '1' | '1' | '1' | '1' | '1' |

In the above Table 3, "1" means that a writing data pulse has been applied during the writing address period while "0" means that a writing data pulse has not been applied during the writing address period. Further, "1" means that an erasing data pulse has been applied during the erasure address period while "0" means that an erasing data pulse has not been applied during the erasure address period. A gray level indicated in Table 3 means a gray level when a writing data pulse has not been applied during a binary coding interval, that is, during an interval of the first to fifth sub-fields SF1 to SF5.

With reference to Table 3, firstly, when a specific discharge cell expresses a gray level "32", a writing data pulse is applied during the writing address period of the sixth sub-field SF6 to thereby select the discharge cell into an on-cell. Thus, the discharge cell generates a sustain discharge corresponding to the gray level "32" during the sustain period of the sixth sub-field SF6. Thereafter, an erasing data pulse is applied during the erasure address period of the seventh sub-field SF7 to thereby select the discharge cell into an off-cell. Thus, a sustain discharge is not generated during the sustain period of the seventh sub-field SF7. Further, an erasing data pulse is applied in the erasure address period so as to keep the discharge cell at an off-cell during the erasure address periods of the eighth to twelfth sub-fields SF8 to SF12. If a specific discharge cell expresses a gray level "32" in this manner, then it is selected into an on-cell only during the address period of the sixth sub-field SF6 while being selected into an off-cell during the address periods of the seventh to twelfth sub-fields SF7 to SF12.

Meanwhile, when a specific discharge cell expresses a gray level "96", a writing data pulse is applied during the writing address period of the sixth sub-field SF6 to thereby select the discharge cell into an on-cell. Thus, the discharge cell generates a sustain discharge corresponding to a gray level "32" during the sustain period of the sixth sub-field SF6. Thereafter, an erasing data pulse is not applied so that the discharge cell can keep an ON state during the erasure address periods of the seventh and eighth sub-fields SF7 and SF8. Thus, a sustain discharge corresponding to a gray level "32" is generated during each sustain period of the seventh and eighth sub-fields SF7 and SF8, thereby expressing a gray level "96" at the discharge cell during one frame.

Thereafter, an erasing data pulse is applied during the erasure address period of the ninth sub-field SF9 to thereby select the discharge cell into an off-cell. Thus, a sustain discharge is not generated during the sustain period of the ninth sub-field SF9. Further, an erasing data pulse is applied in the erasure address period so as to keep the discharge cell at an off-cell during an interval of the tenth to twelfth sub-fields SF10 to SF12. In other words, when a specific discharge cell expresses a gray level "96", it keeps an ON state during an interval of the sixth to eighth sub-fields SF6 to SF8 while keeping an OFF state during an interval of the ninth to twelfth sub-fields SF9 to SF12.

However, such a present data pulse application has a disadvantage in that a power is wasted unnecessarily. More specifically, if the discharge cell at the previous sub-field has been turned off at the selective erasing sub-fields SF7 to SF12 operated by the linear coding, then an erasing data pulse is applied during the erasure address period of the sub-field positioned at the later time interval so as to keep an OFF state of the discharge cell.

For instance, when a gray level "32" is expressed, an erasing data pulse is applied so as to select the discharge cell into an off-cell during the erasure address period of the seventh sub-field SF7. Thereafter, an erasing data pulse is applied so as to keep the discharge cell into an OFF state during the erasure address periods of the eighth to twelfth sub-fields SF8 to SF12. However, since the discharge cell is substantially selected into an off-cell during an interval of the seventh sub-field SF7, the discharge cell fails to be selected into an on-cell during the intervals of the sub-fields SF8 to SF12 after the seventh sub-field SF7. In other words, the discharge cell fails to be selected into an on-cell even though a data pulse is not applied during the erasure address periods of the eighth to twelfth sub-fields SF8 to SF12.

Likewise, when a gray level "0" is expressed, an erasing data pulse for keeping the discharge cell at an off-cell is applied during the erasure address periods of the seventh to twelfth sub-fields SF7 to, SF12. However, since the discharge cell has been selected into an OFF state in an interval of the sixth sub-field SF6, the discharge cell fails to be selected into an on-cell during an interval of the sub-fields SF7 and SF8 after the sixth sub-field SF6. In other words, in the data pulse application scheme indicated in Table 3, an erasing data pulse is applied unnecessarily to thereby cause an unnecessary waste of power.

In order to solve such a disadvantage, the data pulse application is established as indicated in the following table:

TABLE 4

| Gray Level | SF1 (1) | SF2 (2) | SF3 (4) | SF4 (8) | SF5 (16) | SF6 (32) | SF7 (32) | SF8 (32) | SF9 (32) | SF10 (32) | SF11 (32) | SF12 (32) |
|---|---|---|---|---|---|---|---|---|---|---|---|---|
| 0 | | Binary coding | | | | "0" | '0' | '0' | '0' | '0' | '0' | '0' |
| 224 | | Binary coding | | | | "1" | '0' | '0' | '0' | '0' | '0' | '0' |
| 192 | | Binary coding | | | | "1" | '0' | '0' | '0' | '0' | '0' | '1' |
| 160 | | Binary coding | | | | "1" | '0' | '0' | '0' | '0' | '1' | '0' |

TABLE 4-continued

| Gray Level | SF1 (1) | SF2 (2) | SF3 (4) | SF4 (8) | SF5 (16) | SF6 (32) | SF7 (32) | SF8 (32) | SF9 (32) | SF10 (32) | SF11 (32) | SF12 (32) |
|---|---|---|---|---|---|---|---|---|---|---|---|---|
| 128 | | Binary coding | | | | "1" | '0' | '0' | '0' | '1' | '0' | '0' |
| 96 | | Binary coding | | | | "1" | '0' | '0' | '1' | '0' | '0' | '0' |
| 64 | | Binary coding | | | | "1" | '0' | '1' | '0' | '0' | '0' | '0' |
| 32 | | Binary coding | | | | "1" | '1' | '0' | '0' | '0' | '0' | '0' |

In the above Table 4, "1" means that a writing data pulse has been applied during the writing address period while "0" means that a writing data pulse has not been applied during the writing address period. Further, "1" means that an erasing data pulse has been applied during the erasure address period while "0" means that an erasing data pulse has not been applied during the erasure address period. A gray level indicated in Table 4 means a gray level when a writing data pulse has not been applied during a binary coding interval, that is, during an interval of the first to fifth sub-fields SF1 to SF5.

With reference to Table 4, firstly, when a specific discharge cell expresses a gray level "32", a writing data pulse is applied during the writing address period of the sixth sub-field SF6 to thereby select the discharge cell into an on-cell. Thus, the discharge cell generates a sustain discharge corresponding to the gray level "32" during the sustain period of the sixth sub-field SF6. Thereafter, an erasing data pulse is applied during the erasure address period of the seventh sub-field SF7 to thereby select the discharge cell into an off-cell. Thus, a sustain discharge is not generated during the sustain period of the seventh sub-field SF7. Herein, an erasing data pulse is not applied during the erasure address periods of the eighth to twelfth sub-fields SF8 to SF12. In other words, an erasing data pulse has been applied during the erasure address period of the seventh sub-field SF7, that is, the discharge cell has been turned off, so that the discharge cell keeps an OFF state even though an erasing data pulse is not applied during the erasure address periods of the eighth to twelfth sub-fields SF8 to SF12. In other words, in the data pulse application scheme as indicated in Table 4, if the discharge cell has been turned off at the previous sub-field (e.g., the seventh sub-field SF7), then an erasing data pulse is not applied during the address periods of the selective erasing sub-fields SF8 to SF12 positioned after the previous sub-field. Accordingly, the data pulse application scheme according to another embodiment of the present invention can prevent an unnecessary waste of power.

Meanwhile, when a specific discharge cell expresses a gray level "0", it keeps an OFF state during an interval of the first to twelfth sub-fields SF1 to SF12. More specifically, a writing data pulse is not applied to the discharge cell during an interval of the sixth sub-field SF6 so as to express a gray level "0". Thus, the discharge cell is turned off during an interval of the sixth sub-field SF6. Thereafter, an erasing data pulse is not applied during the erasure address periods of the seventh to twelfth sub-fields SF7 to SF12. In other words, the discharge cell has been turned off at the sixth sub-field SF6, so that the discharge cell keeps an OFF state even though an erasing data pulse is not applied during the erasure address periods of the seventh to twelfth sub-fields SF7 to SF12. As described above, in the data pulse application scheme according another embodiment of the present invention, an erasing data pulse is not applied when the discharge cell has been turned off at the sub-field prior to the sub-field driven in the selective erasing system, thereby reducing power consumption.

Meanwhile, if a single of erasing data pulse only is applied during one frame so as to turn off the discharge cell as indicated in Table 4, then the discharge cell may be subject to an unstable turn-off due to an external condition (e.g., a temperature).

Accordingly, there is additionally suggested a data pulse application scheme as indicated in the following table:

TABLE 5

| SF1 (1) | SF2 (2) | SF3 (4) | SF4 (8) | SF5 (16) | SF6 (32) | SF7 (32) | SF8 (32) | SF9 (32) | SF10 (32) | SF11 (32) | SF12 (32) |
|---|---|---|---|---|---|---|---|---|---|---|---|
| Selection of at least one sub-field | | | | | | '1' | '1' | '1' | '0' | '0' | '0' |
| Selection of at least two sub-field | | | | | | '1' | '1' | '0' | '0' | '0' | '0' |
| Selection of at least four sub-field | | | | | | '1' | '0' | '0' | '0' | '0' | '0' |

In the above Table 5, "1" means that an erasing data pulse has been applied during the erasure address period while "0" means that an erasing data pulse has not been applied during the erasure address period.

With reference to Table 5, the number of erasing data pulses applied to turn off the discharge cell during an interval of the selective erasing sub-field ESF is determined by the number of writing data pulses applied at the previous selective writing sub-field WSF. In other words, the number of erasing data pulses applied to turn off the discharge cell during one frame interval is set to be in inverse proportion to the number of writing data pulses applied to turn on the discharge cell during one frame interval.

If a writing data pulse has been applied in the address periods of a large number of selective writing sub-fields WSF within one frame, then an erasing data pulse is applied in the address periods of a small number of selective erasing sub-fields ESF so as to turn off the discharge cell. On the other hand, if a writing data pulse has been applied in the address periods of a small number of selective writing sub-fields WSF within one frame, then an erasing data pulse is applied in the address periods of a large number of selective erasing sub-fields ESF so as to turn off the discharge cell. If erasing data pulses for turning off the discharge cell are applied in such a manner to be in inverse proportion to the number of wring data pulses as described above, then a stable turning-off of the discharge cell can be made.

For instance, an erasing data pulse is applied in the address period of a single of selective erasing sub-field ESF so as to turn off the discharge cell supplied with a writing data pulse in the address periods of at least four selective writing sub-fields WSF as indicated in Table 5. Herein, a lot of charged particles exist in the discharge cell when at least four writing data pulse are applied, so that a stable turning-off of the discharge cell can be made by an application of only a single of erasing data pulse.

Further, an erasing data pulse is applied in the address periods of at least three selective erasing sub-fields ESF so as to turn off the discharge cell supplied with a writing data pulse in the address period of a single of selective writing sub-field WSF. The erasing data pulse is continuously applied at adjacent selective erasing sub-fields. Herein, since a small amount of charged particles exist in the discharge cell when a single of writing data pulse is applied, at least three erasing data pulses are applied to cause a stable turning-off of the discharge cell.

Furthermore, an erasing data pulse is applied in the address periods of at least two selective erasing sub-fields ESF so as to turn off the discharge cell supplied with a writing data pulse in the address periods of at least two selective writing sub-field WSF. The erasing data pulse is continuously applied at adjacent selective erasing sub-fields. Experimentally, if at least two erasing data pulses are applied to turn off the discharge cell supplied with at least two writing data pulses, then a stable turning-off of the discharge cell is made.

Alternatively, the number of erasing data pulses applied during an interval of the selective erasing sub-field ESF may be determined in correspondence with the number of cells turned on at one frame as indicated in the following table:

TABLE 6

| Number of Sub-fields Turned on | Number of Erasing Data pulses |
|---|---|
| Selection of at least one sub-field | Three Erasing Data Pulses |
| Selection of at least two sub-field | Two Erasing Data Pulses |
| Selection of at least four sub-field | One Erasing Data Pulse |

With reference to Table 6, the number of erasing data pulses applied to turn off the discharge cell during an interval of the selective erasing sub-field ESF is determined in correspondence with the number of sub-fields turned on at one frame including the selective writing sub-field WSF and the selective erasing sub-field ESF. In other words, the number of erasing data pulses applied to turn off the discharge cell during one frame interval is set to be in inverse proportion to the number of sub-fields turned on at one frame.

If a specific discharge cell has been turned on during an interval of a large number of sub-fields WSF and ESF within one frame, then a small number of erasing data pulses are applied to turn off the specific discharge cell. On the other hand, if a specific discharge cell has been turned on during an interval of a small number of sub-fields WSF and ESF within one frame, then a large number of erasing data pulses are applied to turn off the specific discharge cell. If erasing data pulses for turning off the discharge cell are applied in such a manner to be in inverse proportion to the number of the turned-on sub-fields as described above, then a stable turning-off of the discharge cell can be made.

For instance, if a specific discharge cell has been turned on at at least four sub-fields (e.g., SF1, SF6, SF7 and SF8) during one frame interval as indicated in Table 6, then an erasing data pulse is applied in the address period of a single of selective erasing sub-field ESF so as to turn off the specific discharge cell. Herein, a lot of charged particles exist in the discharge cell turned on during an interval of at least four sub-fields, so that a stable turning-off of the discharge cell can be made by an application of only a single of erasing data pulse.

Further, if a specific discharge cell has been turned on at a single of sub-field during one frame interval, then an erasing data pulse is applied in the address periods of at least three selective erasing sub-fields ESF so as to turn off the specific discharge cell. The erasing data pulse is continuously applied at adjacent selective erasing sub-fields. Herein, since a small amount of charged particles exist in the discharge cell turned on an interval of a single of sub-field, at least three erasing data pulses are applied to cause a stable turning-off of the discharge cell.

Furthermore, if a specific discharge cell has been turned on at at least two sub-fields (e.g., SF6 and SF7) during one frame interval, then an erasing data pulse is applied in the address periods of at least two selective erasing sub-fields ESF so as to turn off the specific discharge cell. The erasing data pulse is continuously applied at adjacent selective erasing sub-fields. Experimentally, if at least two erasing data pulses are applied to turn off the discharge cell turned on at at least two sub-fields, then a stable turning-off of the discharge cell is made.

Meanwhile, an application frequency of an erasing data pulse applied in the selective erasing sub-field ESF can be controlled in correspondence with a temperature. For instance, since particles are easily activated at a high temperature more than 40° C., the discharge cell is easily turned off even though a small number of (e.g., i) erasing data pulses (wherein i is an integer) are applied within one frame. Thus, when the panel is driven at a high temperature, a small number of (e.g., i=1) erasing data pulse is applied to turn off the discharge cell in the address period of the selective erasing sub-field ESF.

On the other hand, since particles fail to be activated at a low temperature less than 0° C., a large number of erasing data pulses should be applied within one frame so as to make a stable turning-off of the discharge cell. Thus, when the panel is driven at a low temperature, a larger number of (e.g. j=3) erasing data pulses (wherein j is an integer) than the number of erasing data pulses when the panel is driven at a high temperature are applied so as to turn off the discharge cell in the address period of the selective erasing sub-field ESF. Further, when the panel is driven at a temperature between the high temperature and the low temperature, erasing data pulses having a number (e.g., two) larger than the number of erasing data pulses when the panel is driven at the high temperature and smaller than the number of erasing data pulses when the panel is driven at the low temperature are applied.

As described above, according to the present invention, one frame is divided into sub-fields in the selective writing system and sub-fields in the selective erasing system for the purpose of driving the PDP. Herein, when the PDP is driven in the selective erasing system, the number of erasing data pulse applied to turn off the discharge cell can be minimized, thereby reducing power consumption.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel, wherein one frame includes a plurality of selective writing sub-fields and a plurality of selective erasing sub-fields, said method comprising:

applying an erasing data pulse only in an address period of any one of the plurality of selective erasing sub-fields so as to turn off a discharge cell wherein if the discharge cell has been turned off at the nth sub-field (wherein n is an integer), then said erasing data pulse is not generated in the address periods of the selective erasing sub-fields arranged after the nth sub-field.

2. The method as claimed in claim 1, wherein the nth sub-field is a selective erasing sub-field.

3. The method as claimed in claim 1, wherein the nit sub-field is a selective writing sub-field arranged prior to said selective erasing sub-field.

4. A method of driving a plasma display panel, wherein one frame includes a plurality of selective writing sub-fields and a plurality of selective erasing sub-fields, and the number of erasing data pulses applied to turn off a specific discharge cell during an interval of the plurality of selective erasing sub-fields is in inverse proportion to the number of selective writing sub-fields turning on the specific discharge cell.

5. The method as claimed in claim 4, wherein, if said specific discharge cell has been turned on at at least four selective writing sub-fields during said one frame, then a single of erasing data pulse is applied to turn off the specific discharge cell.

6. The method as claimed in claim 4, wherein, if said specific discharge cell has been turned on at a single of selective writing sub-field during said one frame, then three erasing data pulses are applied to turn off the specific discharge cell.

7. The method as claimed in claim 6, wherein said erasing data pulse is continuously applied to adjacent selective erasing sub-fields.

8. The method as claimed in claim 4, wherein, if said specific discharge cell has been turned on at at least two selective writing sub-fields during said one frame, then two erasing data pulses are applied to turn off the specific discharge cell.

9. The method as claimed in claim 8, wherein said erasing data pulse is continuously applied to adjacent selective erasing sub-fields.

10. A method of driving a plasma display panel, wherein one frame includes a plurality of selective writing sub-fields and a plurality of selective erasing sub-fields, and the number of erasing data pulses applied to turn off a specific discharge cell during an interval of the plurality of selective erasing sub-fields is in inverse proportion to the number of selective writing sub-fields and selective erasing sub-fields that turn on the specific discharge cell during said one frame interval.

11. The method as claimed in claim 10, wherein, if said specific discharge cell has been turned on at at least four sub-fields during said one frame, then a single of erasing data pulse is applied to turn off the specific discharge cell.

12. The method as claimed in claim 10, wherein, if said specific discharge cell has been turned on at a single of sub-field during said one frame, then three erasing data pulses are applied to turn off the specific discharge cell.

13. The method as claimed in claim 12, wherein said erasing data pulse is continuously applied to adjacent selective erasing sub-fields.

14. The method as claimed in claim 10, wherein, if said specific discharge cell has been turned on at at least two sub-fields during said one frame, then two erasing data pulses are applied to turn off the specific discharge cell.

15. The method as claimed in claim 14, wherein said erasing data pulse is continuously applied to adjacent selective erasing sub-fields.

16. A method of driving a plasma display panel, wherein one frame includes a plurality of selective writing sub-fields and a plurality of selective erasing sub-fields, said method comprising:

applying a writing data pulse during an address period of said selective writing sub-field to thereby select a specific discharge cell into an on-cell; and applying an erasing data pulse during an address period of at least one selective erasing sub-field of the plurality of selective erasing sub-fields to thereby turn off the specific discharge cell, wherein the number of said erasing data pulses applied to the specific discharge cell is set to be differentiated depending upon a peripheral temperature at which the panel is driven.

17. The method as claimed in claim 16, wherein, when the panel is driven at a high temperature, i erasing data pulses (wherein i is an integer) are applied to the specific discharge cell.

18. The method as claimed in claim 17, wherein said high temperature is more than 40° C.

19. The method as claimed in claim 17, wherein, when the panel is driven at a low temperature, j erasing data pulses (j is an integer than larger than i) are applied to the specific discharge cell.

20. The method as claimed in claim 17, wherein said low temperature is less than 0° C.

21. The method as claimed in claim 19, wherein, when the panel is driven at a temperature between said high temperature and said low temperature, erasing data pulses having the number larger than i and smaller than j are applied to the specific discharge cell.

* * * * *